US006935854B2

(12) United States Patent
Kuwahara

(10) Patent No.: US 6,935,854 B2
(45) Date of Patent: Aug. 30, 2005

(54) GAS COMPRESSOR

(75) Inventor: Okikazu Kuwahara, Chiba (JP)

(73) Assignee: Calsonic Compressors Manufacturing Inc., Chiba (JP)

( * ) Notice: Subject to any disclaimer, the term of this patent is extended or adjusted under 35 U.S.C. 154(b) by 0 days.

(21) Appl. No.: 10/443,223

(22) Filed: May 22, 2003

(65) Prior Publication Data

US 2004/0001771 A1 Jan. 1, 2004

(30) Foreign Application Priority Data

May 24, 2002 (JP) ..... 2002-151394
Apr. 2, 2003 (JP) ..... 2003-099109

(51) Int. Cl.[7] ..... F03C 2/00

(52) U.S. Cl. ..... 418/259; 418/15; 418/76; 418/81; 418/82; 418/93; 418/99; 418/268

(58) Field of Search ..... 418/259, 268, 418/15, 76–77, 81–82, 93, 99

(56) References Cited

U.S. PATENT DOCUMENTS 3,834,846 A 9/1974 Linder et al.
4,468,180 A * 8/1984 Shibuya ..... 418/15
4,507,065 A 3/1985 Shibuya et al.
4,514,157 A * 4/1985 Nakamura et al. ..... 418/259
4,608,002 A * 8/1986 Hayase et al. ..... 418/86
4,824,330 A 4/1989 Kobayashi et al.
5,411,385 A * 5/1995 Eto et al. ..... 418/96

FOREIGN PATENT DOCUMENTS

EP 0600313 6/1994
JP 58135396 A * 8/1983 ..... F04C/18/344
JP 61187991 11/1986
JP 63117193 A * 5/1988 ..... F04C/18/344

* cited by examiner

*Primary Examiner*—Theresa Trieu
(74) *Attorney, Agent, or Firm*—Adams & Wilks

(57) ABSTRACT

A gas compressor has a cylinder in which a refrigerant gas is compressed and a side block mounted to an end surface of the cylinder. The side block has suction holes each having a first end opening to an outer surface of the side block and a second end opening into the cylinder. A front head has a suction port, an inner surface, and a hollow portion disposed in the inner surface. The front head is disposed on an outer surface of the side block so that the hollow portion and the outer surface of the side block form suction passages extending from the suction port to respective suction holes of the side block. Each of the suction passages form a main flow passage along which refrigerant gas flows from the suction port to a corresponding one of the suction holes of the side block. The hollow portion has a generally flat wall surface at a region corresponding to each of the main flow passages.

12 Claims, 10 Drawing Sheets

SYMBOL INDICATING FLOW OF REFRIGERANT GAS
R
3B
14
15
18
18-1
D
17
E
3
19
5
5a
16
S
R-1
F
G

FIG.4

[MEASUREMENT CONDITIONS]
COMPRESSOR USED:VANE ROTARY TYPE COMPRESSOR
REVOLUTIONS PER MINUTE:1000rpm
PRESSURE CONDITION:Pd/Ps=15/2(kgf/cm$^2$)
DEGREE OF SUPER HEATING/DEGREE OF SUPER COOLING=10/0( C)
COMPRESSOR OF PRESENT INVENTION: ONE WITH FLAT AND SMOOTH FRONT HEAD AND FRONT SIDE BLOCK

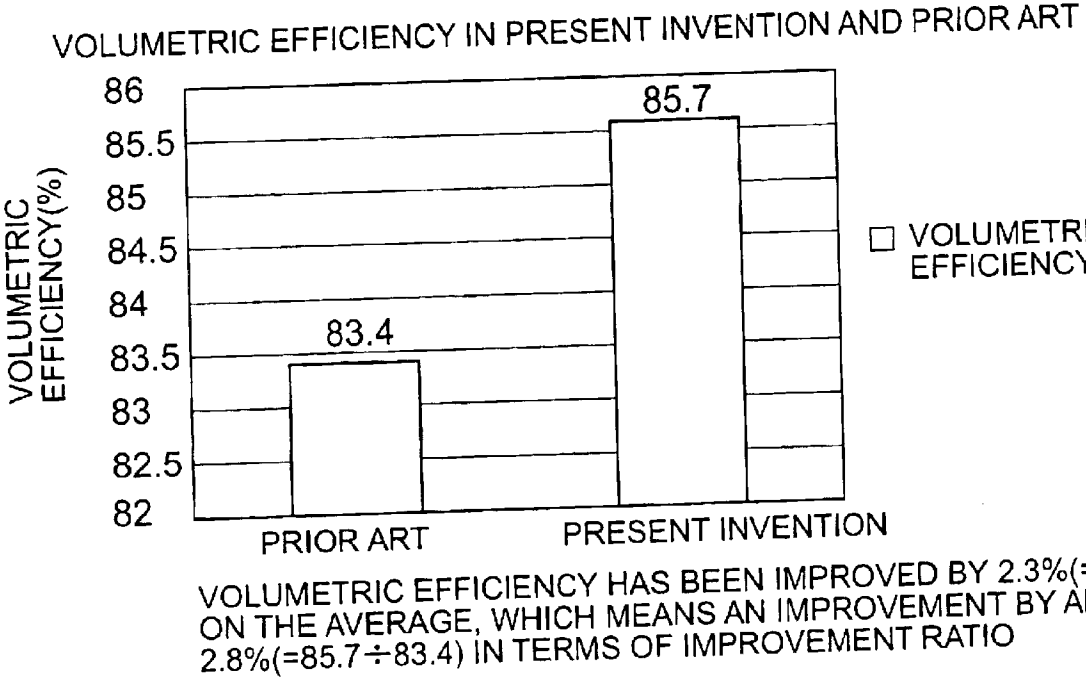

VOLUMETRIC EFFICIENCY HAS BEEN IMPROVED BY 2.3%(=85.7-83.4) ON THE AVERAGE, WHICH MEANS AN IMPROVEMENT BY APPROXIMATELY 2.8%(=85.7÷83.4) IN TERMS OF IMPROVEMENT RATIO

5B
R
14
15
18
18-1
17
3
5
5a
16
S
R-1

| PASSAGE MINIMUM SECTIONAL AREA | VOLUMETRIC EFFICIENCY |
|---|---|
| 0.5 | 75 |
| 0.8 | 82 |
| 1.1 | 84 |
| 2 | 83 |
| 2.5 | 80 |

| CLOSING PORTION SECTIONAL AREA | VOLUMETRIC EFFICIENCY |
|---|---|
| 0 | 84 |
| 0.2 | 83.7 |
| 0.4 | 82.6 |
| 0.6 | 82 |
| 1 | 81 |

GAS COMPRESSOR

BACKGROUND OF THE INVENTION

1. Field of the Invention

The present invention relates to a gas compressor for use in an automotive air conditioning system or the like and, in particular, to a gas compressor with improved cooling capacity.

2. Description of the Related Art

FIGS. 9A and 9B shows a conventionally known vane rotary type gas compressor. In the conventional gas compressor shown, a refrigerant gas is compressed in a cylinder 4 of a gas compressor main body 2. The refrigerant gas compressed is sucked from a suction port 17 of a front head 3 constituting a refrigerant guide passage into the cylinder 4 by way of a suction chamber 150 inside the front head 3 and a side block suction hole 16.

As shown in FIGS. 10A to 10E, the above gas compressor of the conventional construction adopts a structure in which the suction chamber 150 is defined by a hollow portion 14 inside the front head 3 and an outer surface 5*a* of a side block 5 opposed thereto. Thus, due to the fact that the suction chamber 150 has a structure as a "chamber" for temporarily storing the refrigerant gas and that the suction chamber 150 has a large number of protrusions and recesses due to a plurality of reinforcing ribs 20 protruding from the outer surface 5*a* of the side block 5, etc., the gas compressor has a problem in that it involves a deterioration in cooling capacity.

That is, the presence of protrusions and recesses in the suction chamber 150 leads to an increase in the frictional resistance of the refrigerant gas passing through the suction chamber 150, resulting in pressure loss of the refrigerant gas. Thus, the pressure of the refrigerant gas at the inlet of the cylinder 4, that is, the pressure of the refrigerant gas immediately before its suction into the cylinder 4 by way of the suction chamber 150 and the side block suction hole 16, becomes excessively low as compared with the pressure of the refrigerant gas on the upstream, suction port 17 side. Due to this reduction in pressure of the refrigerant gas, the density of the refrigerant gas sucked into the cylinder 4 is reduced, with the result that the amount of refrigerant gas sucked into the cylinder 4 decreases, resulting in a deterioration in the cooling capacity of the gas compressor.

Further, the longer the refrigerant gas stays in the suction chamber 150 described above, the more heat it takes from the front head 3, the parts of the side block 5, etc. As a result, the temperature of the refrigerant gas rises to an excessive degree. Furthermore, the higher the temperature of the refrigerant gas, the lower the density of the refrigerant gas.

In particular, when the gas compressor is operated at a low rotating speed, the flow velocity of the refrigerant gas is low, so that the refrigerant gas is liable to stay within the suction chamber 150, and the quantity of the heat that the refrigerant gas takes from the front head 3, the parts of the side block 5, etc. increases, which leads to a further increase in the temperature of the refrigerant gas, resulting in a substantial deterioration in cooling capacity.

Incidentally, instead of the suction chamber 150 in the form of a "chamber" as described above, some conventional gas compressors adopt a suction passage in the form of a "passage" (See, for example, JP 58-135396 A and JP 9-158868 A).

The gas compressor as disclosed in JP 58-135396 A is equipped with one suction passage (as indicated at 30 in FIG. 3 of the publication) extending spirally from a suction port (as indicated at 32 in FIG. 3 of the publication). Opened respectively at a midpoint and a terminal of this spiral suction passage are two side block suction holes (as indicated at 34*a* and 34*b* of the drawing). As a result, the distance from the suction port constituting the suction start point to the final side block suction hole situated at the terminal end of the suction passage is inevitably rather long. Before it reaches the side block suction hole at the terminal end, the refrigerant gas takes a large quantity of heat from the side block (indicated at 18 in the drawing), etc., resulting in an increase in the temperature of the refrigerant gas and, consequently, a reduction in the gas density, which is quite likely to lead to a deterioration in cooling capacity.

In the gas compressor as disclosed in JP 9-158868 A, there is formed a suction passage (indicated at 11 in FIG. 2 of the publication) by utilizing an end surface of a cam ring (indicated at 1 in FIG. 1 of the publication) corresponding to the cylinder 4 shown in FIG. 9A of the present application. More specifically, a passage-like hollow portion is formed in the inner side surface of a rear head (indicated at 6 in FIGS. 1 and 2 of the publication) opposed to the end surface of the cam ring (indicated at 1 in FIG. 1 of the publication), and a suction passage is defined by the passage-like hollow portion and the end surface of the cam ring. Thus, due to the presence of the suction passage, it is impossible to secure to a sufficient degree the sealing surface on the cam ring end surface side. The shortage of sealing surface is likely to cause what is called an inner leakage, in which a compressed high-pressure refrigerant gas is leaked from the inner side of the cam ring to the low-pressure side. As a result of this inner leakage, the amount of refrigerant gas sucked in is reduced, which is quite likely to lead to a deterioration in cooling capacity.

Also in the above-described suction passage structure utilizing the end surface of the cam ring, it is possible to secure a sufficient passage sectional area for the suction passage and reduce the suction resistance of the refrigerant gas either by forming the suction passage deep or by enlarging the width of the suction passage. However, in the case in which the suction passage is formed deep, it is necessary, from the viewpoint of the strength of the rear head, to form the rear head thick accordingly. Further, in the case in which the width of the suction passage is enlarged, it is necessary to radially expand the rear head and the cam ring in order to secure the requisite sealing surface on the cam ring end surface side. Thus, in either case, an increase in the size of the gas compressor is inevitable.

SUMMARY OF THE INVENTION

The present invention has been made with a view toward solving the above problems. It is an object of the present invention to provide a gas compressor of a small size and suitable for achieving an improvement in terms of cooling capacity.

In order to attain the above-mentioned object, a gas compressor according to the present invention is characterized by including: a cylinder in which a refrigerant gas is compressed; a side block mounted to an end surface of the cylinder; a front head arranged on an outer surface side of the side block; a suction port provided in the front head; a plurality of side block suction holes open at one end in the outer surface of the side block and open at the other end into the cylinder; a passage-like hollow portion provided in the inner surface of the front head and branching off from the suction port to extend toward the side block suction holes;

and a refrigerant gas suction passage defined for each of the side block suction holes by the passage-like hollow portion in the inner surface of the front head and the outer surface of the side block.

According to the gas compressor of the present invention, the hollow portion may be of a structure which has in a main flow passage for the refrigerant gas flowing, during operation of the compressor, from the suction port toward the side block suction holes a flat wall surface extending along the direction in which the refrigerant gas flows.

According to the gas compressor of the present invention, the hollow portion may employ a structure which is entirely closed by a closing portion except for the main flow passage for the refrigerant gas flowing, during operation of the compressor, from the suction port toward the side block suction holes.

According to the gas compressor of the present invention, the hollow portion may employ a structure which has in a main flow-passage for the refrigerant gas flowing, during operation of the compressor, from the suction port toward the side block suction holes a flat wall surface extending along the direction in which the refrigerant gas flows and which is entirely closed by a closing portion except for the main flow passage for the refrigerant gas.

According to the gas compressor of the present invention, a structure may be employed in which the outer surface of the side block opposed to the hollow portion is formed as a flat surface.

According to the gas compressor of the present invention, it is preferable that the minimum passage sectional area of every one of the suction passages formed respectively for the side block suction holes is 0.9 to 2 times the sectional area of the suction port.

Further, according to the gas compressor of the present invention, it is preferable that the sectional area of the portion between the closing portion and the side block outer surface opposed thereto is 0 to 0.2 times the sectional area of the suction port.

BRIEF DESCRIPTION OF THE DRAWINGS

FIG. 1A is a sectional view of the gas compressor, and FIG. 1*b* is an outward view of the gas compressor as seen from the direction of the arrow A of FIG. 1A.

FIG. 3A is a diagram showing the configuration of the inner surface side of the front head, FIG. 3B is a sectional view taken along the line 3B—3B of FIG. 3A, FIG. 3C is a diagram showing the configuration of the outer surface of the side block, FIG. 3D is a perspective view of the side block, and FIG. 3E is an explanatory view showing how the front head of FIG. 3A and the side block of FIG. 3C are combined with each other.

FIG. 4 is an explanatory diagram showing data obtained through an experiment in which the gas compressor according to an embodiment of the present invention shown in FIGS. 1A, 1B and the conventional gas compressor shown in FIG. 9 were compared with each other in terms of volumetric efficiency.

FIG. 5A is a diagram showing the configuration of the inner surface side of the front head, FIG. 5B is a sectional view taken along the line 5B—5B of FIG. 5A, FIG. 5C is a diagram showing the configuration of the outer surface of the side block FIG. 5D is a perspective view of the side block, and FIG. 5E is an explanatory view showing how the front head of FIG. 5A and the side block of FIG. 5C are combined with each other.

FIG. 6A is a diagram showing the configuration of the inner surface side of the front head, FIG. 6B is a sectional view taken along the line 6B—6B of FIG. 6A, FIG. 6C is a diagram showing the configuration of the outer surface of the side block FIG. 6D is a perspective view of the side block, and FIG. 6E is an explanatory view showing how the front head of FIG. 6A and the side block of FIG. 6C are combined with each other.

FIG. 9A is a sectional view of the conventional gas compressor, and FIG. 9B is an outward view of the front head of the conventional gas compressor as seen from the direction of the arrow A in FIG. 9A.

FIG. 10A is a diagram showing the configuration of the inner surface side of the front head of FIG. 10A and the side block of FIG. 10C are combined with each other.

DETAILED DESCRIPTION OF THE PREFERRED EMBODIMENTS

An embodiment of a gas compressor of the present invention will now be described in detail with reference to FIGS. 1A, 1B through FIGS. 6A to 6E.

Figure 1B:
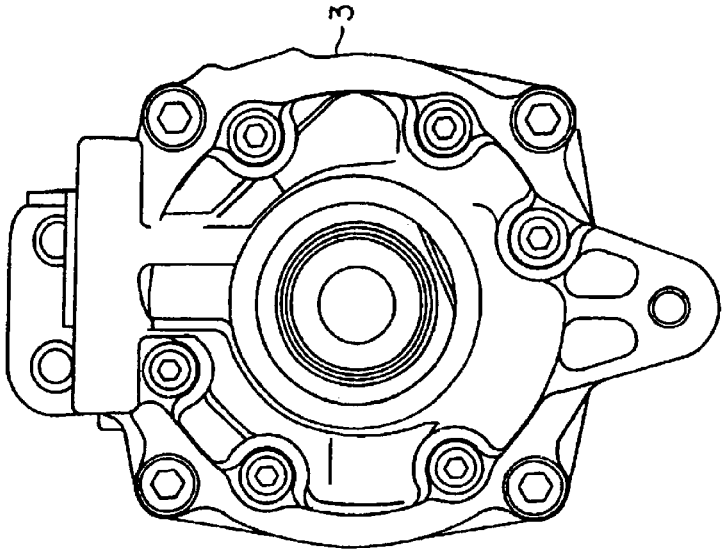
FIGS. 1A and 1B are an explanatory view of a gas compressor according to an embodiment of the present invention, where
Figure 1A:
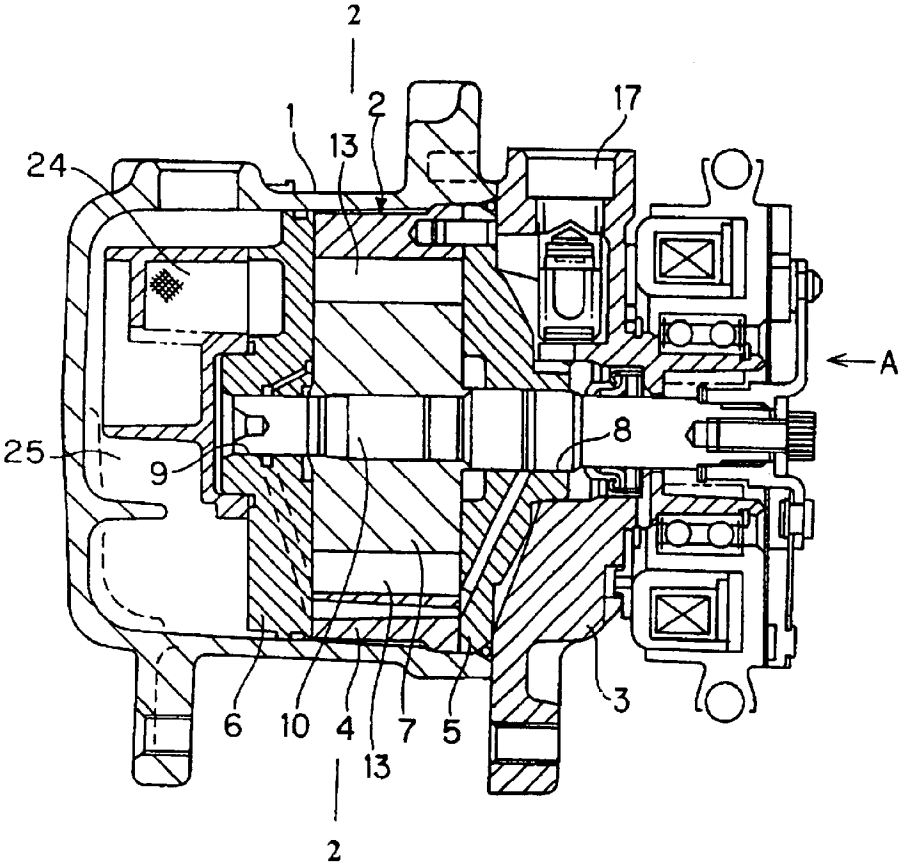

FIGS. 1A and 1B show a gas compressor adopting a so-called shell structure in which a compressor main body 2 is accommodated in a compressor case 1 open at one end, with a front head 3 having a suction port 17 being mounted to the open end of the compressor case 1.

The compressor main body 2 has a cylinder 4 with a substantially elliptical inner periphery. Mounted to the front-side end surface of this cylinder 4, that is, the end surface thereof opposed to the inner surface of the front head 3, is a side block 5. Upon seeing this mount state from the front head 3 side, the front head 3 is arranged on the outer surface 5*a* side of the side block 5. Further, another side block 6is mounted to the rear end surface of the cylinder 4.

A rotor 7 is installed inside of the cylinder 4. The rotor 7 is provided so as to be rotatable around the rotor axis integrally with a rotor shaft 10 through the intermediation of hole-like bearings 8 and 9 provided in the side blocks 5 and 6 and the rotor shaft 10 supported by the bearings 8 and 9.

Figure 2:
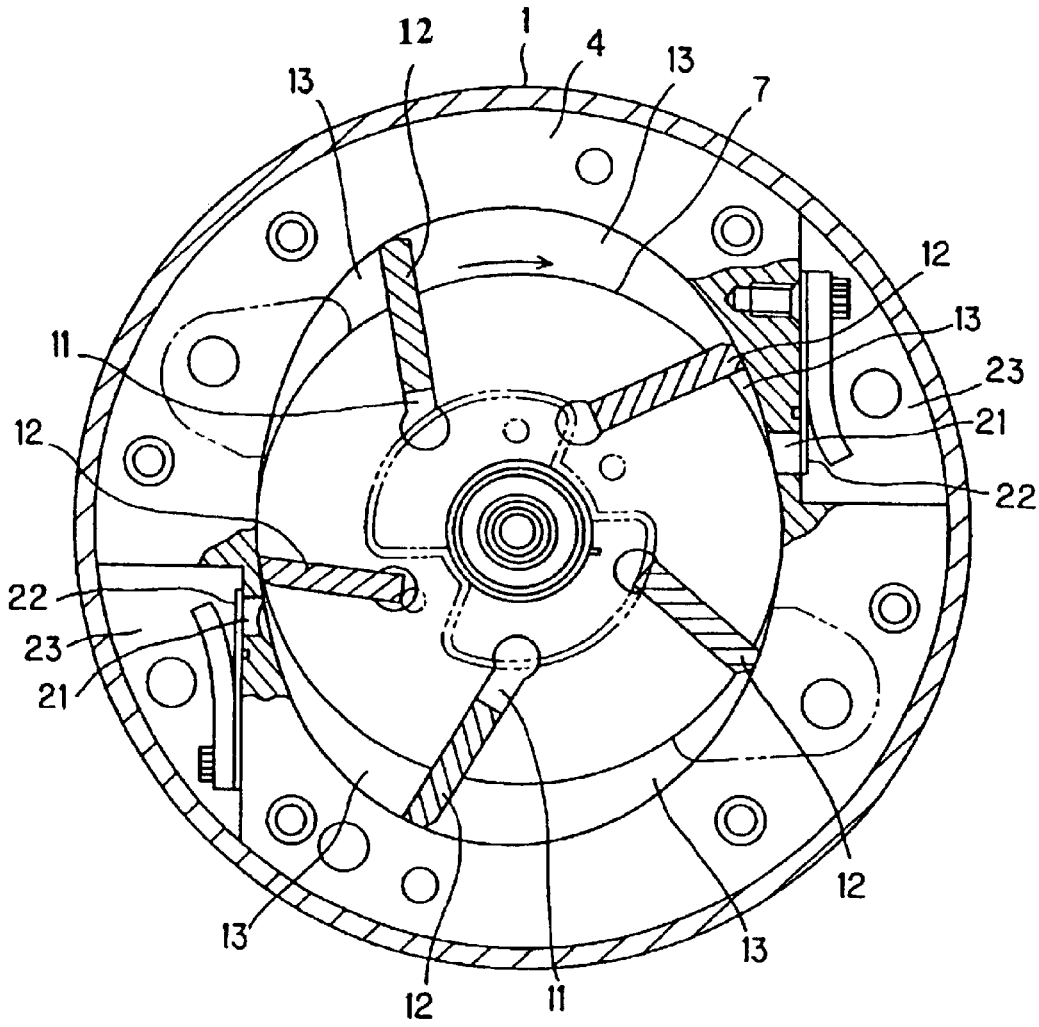
FIG. 2 is a sectional view taken along the line 2—2 of FIG. 1A.

As shown in FIG. 2, five vane grooves 11 are formed in the outer peripheral surface of the rotor 7. These vane grooves 11 are provided radially in the rotor 7, and a vane 12 is slidably inserted into each vane groove 11.

In the gas compressor of this embodiment shown in FIGS. 1A and 1B, a refrigerant gas is compressed inside the cylinder 4.

That is, in the gas compressor of this embodiment, the internal space of the cylinder 4 is divided into a plurality of small chambers by the inner wall surface of the cylinder 4, the inner surfaces of the side blocks 5 and 6, the outer peripheral surface of the rotor 7, and both side surfaces of the forward end portion of each vane 12, and the small chambers thus defined function as compression chambers 13 for compressing a refrigerant gas.

Specifically, the compression chambers 13 repeat changes in volume as the vanes 12 undergo changes in rotating angle as the rotor 7 rotates, and, through these changes in volume, a refrigerant gas is sucked in, compressed, and discharged.

In the above-mentioned processes of sucking in, compressing, and discharging the refrigerant gas, the vanes 12 slide within the vane grooves 11 of the rotor 7, and perform protruding and retracting movements between the outer peripheral surface of the rotor 7 and the inner peripheral surface of the cylinder 4. In this process, the vanes 12 are constantly urged toward and pressed against the inner peripheral surface of the cylinder 4 by the centrifugal force resulting from the rotation of the rotor 7 and vane back pressure supplied to the bottom portions of the vanes 12.

The side block 5 has suction holes 16. These suction holes (hereinafter referred to as the "side block suction holes") 16 are open at one end in the outer peripheral surface 5*a* of the side block 5. Further, these side block suction holes 16 are open at the other end into the cylinder 4.

In the gas compressor of this embodiment, a series of operations of sucking, compressing, and discharging the refrigerant gas are conducted at the compression chamber 13 individually within a range of rotation of the rotor 7, which ranges from 0 to 180 degrees, starting from a position near a short diameter portion of the ellipse of the cylinder 4. Further, a similar series of operations of suction, compression, and discharge are conducted at the compression chamber 13 individually within another range of rotation of the rotor 7 from the position of the rotating angle of 180 degrees to the position of the rotating angle of 0 degrees. That is, two cycles of sucking operations are conducted at one compression chamber 13 during one rotation, so that two side block suction holes 16 are provided. More specifically, the two side block suction holes 16 are respectively provided at diagonally opposed positions through the intermediation of the rotor shaft 10. Thus, in the case of this embodiment, the number of side block suction holes 16 provided in the side block 5 is two in total.

A hollow portion 14 is formed in the inner surface of the front head 3. This hollow portion 14 is a "passage" having no protrusions or recesses on the wall surface, and is formed such that during operation of the compressor, the refrigerant gas flows in one direction from the suction port 17 of the front head 3 toward the side block suction holes 16. Thus, unlike the conventional "chamber", this hollow portion 14 involves no residence or vortex of the refrigerant gas. Further, this hollow portion 14 is formed as a bifurcated passage branching at the suction port 17 and heading toward the two side block suction holes 16.

A suction passage 15 is formed individually for each side block suction hole 16 by the passage-like hollow portion 14 in the inner surface of the front head 3 and the outer surface 5*a* of the side block 5.

As described above, the hollow portion 14 in the inner surface of the front head is formed as a bifurcated passage, so that the suction passages 15 formed by the hollow portion 14 and the side block outer surface 5*a* are also formed in a bifurcated-passage-like configuration. Then, at the terminal end of each of the two bifurcated suction passages 15, there is arranged in an open state a side block suction hole 16. Thus, a low-pressure refrigerant gas to be compressed in the cylinder 4 is sucked into the cylinder 4 from the side block suction holes 16 by way of the suction passages 15 bifurcated at the suction port 17 of the front head 3.

As described above, in forming the hollow portion 14 in the inner surface of the front head as a passage, this embodiment adopts a structure in which a wall surface forming portion 18 and a closing portion 19 are formed in the inner surface of the front head 3.

The wall surface forming portion 18 is constructed such that, of the entire hollow portion 14 in the inner surface of the front head 3, there is formed a flat wall surface 18-1 extending along the refrigerant gas flowing direction at the portion corresponding to the main flow passage R for the refrigerant gas flowing in one direction from the suction port 17 toward the side block suction holes 16 during operation of the compressor.

The reason for adopting the above-described flat wall surface structure is to enable the refrigerant gas to flow smoothly along the flat wall surface 18-1 in the hollow portion 14 in the inner surface of the front head, whereby the frictional resistance and pressure loss of the refrigerant gas in the refrigerant guide passage are reduced, and the density of the refrigerant gas sucked into the cylinder 4 is enhanced, thereby achieving an improvement in cooling capacity.

Here, the above expression: "flowing in one direction from the suction port 17 toward the side block suction holes 16" refers to the phenomenon taking place during operation of the compressor, and the condition in which the refrigerant gas flows from the suction port 17 toward the side block suction holes 16 in the shortest distance without involving any vortex. Thus, no vortex is generated in the flow of the refrigerant gas in the main flow passage R of the refrigerant gas. Note that when the compressor is at rest, the flowing direction of the refrigerant gas in the main flow passage R may be reverse to that during operation of the compressor depending on difference in pressure.

The closing portion 19 is formed so as to close the entire hollow portion 14 in the inner surface of the front head 3 except for the main flow passage R for the refrigerant gas.

The reason for adopting the partially closed structure for the hollow portion 14 is to reduce the residence amount and residence time of the refrigerant gas deviated from the main flow passage R and residing in the hollow portion 14 in the inner surface of the front head. Thus, it is possible to prevent an increase in temperature due to residence of the refrigerant gas and a reduction in the gas density resulting therefrom. Therefore, the density of the refrigerant gas sucked into the cylinder 4 is enhanced, thereby making it possible to achieve an improvement in cooling capacity.

In the case of this embodiment, in the hollow portion 14 in the inner surface of the front head, the main flow passage R for the refrigerant gas assumes a flow passage configuration such that it is bent into an L-shape for a change of direction at the downstream end thereof, that is, in the vicinity of the portion immediately before the side block suction holes 16. This bent portion R-1 at the downstream end of the main flow passage R is formed in a curved configuration with a large radius of curvature, whereby the main flow passage R as a whole is formed as a continuous surface having no corner portion.

The reason for adopting the construction in which the bent portion R-1 of the main flow passage R is formed in a curved configuration with a large radius of curvature and in which the main flow passage R as a whole is formed as a continuous surface, is to make the flow of the refrigerant gas in the refrigerant gas guide passage smooth and to reduce as much as possible the pressure loss of the refrigerant gas, thereby achieving an improvement in cooling capacity.

Generally speaking, in the case in which there is a corner portion in a part of the flow passage for the refrigerant gas and in which the flow passage as a whole is formed as a discontinuous surface, and in the case in which the bent portion in the flow passage is formed in a steeply curved configuration with a small radius of curvature, the pressure loss of the refrigerant gas becomes large. At the portion (corner portion) where the continuity of the flow passage inner surface is interrupted and in the steeply curved bent portion, the frictional resistance of the refrigerant gas becomes particularly large. Further, a turbulence or vortex is generated in the refrigerant gas flow, resulting in an increase in pressure loss and a deterioration in cooling capacity.

In contrast, in the case in which the refrigerant gas flow passage as a whole is formed as a continuous surface and in the case in which the bent portion in the flow passage for the refrigerant gas is formed in a curved configuration with a large radius of curvature, the refrigerant gas flows smoothly through the entire flow passage, and the pressure loss is suppressed, thereby achieving an improvement in cooling capacity.

In view of this, in this embodiment, the main flow passage R is formed by a continuous surface as described above, and the bent portion R-1 in the main flow passage R is formed in a curved configuration with a large radius of curvature. Thus, there is a limitation to the radius of curvature of the curved configuration of the bent portion R-1, in particular; it is to be appropriately determined in accordance with the pressure loss of the refrigerant gas, etc.

As stated above, the hollow portion 14 in the inner surface of the front head 3 is formed as a "passage" having no protrusions or recesses on the wall surface. In this embodiment, the outer surface 5*a* of the side block 5 opposed to the hollow portion 14 in the inner surface of the front head 3 is also formed as a flat surface S free from protrusions or recesses.

Figure 9B:
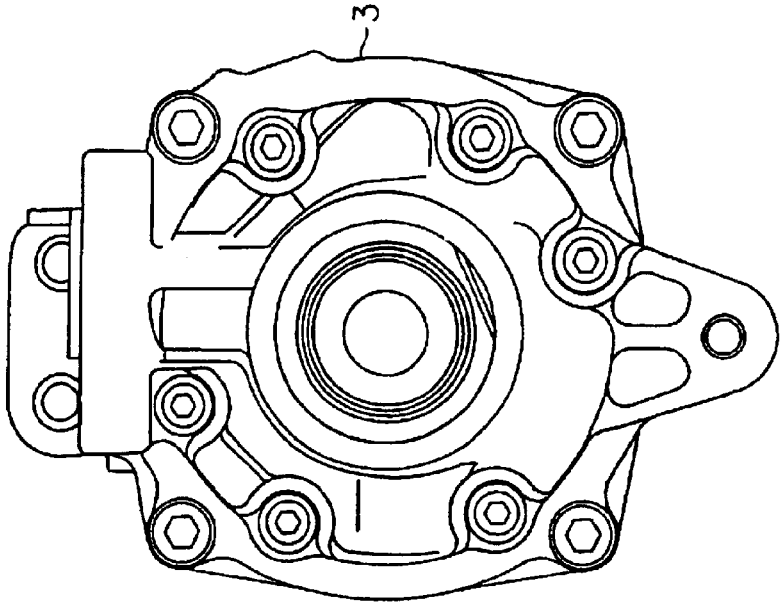
PRIOR ART FIG. 9B
FIGS. 9A and 9B are explanatory views of a conventional gas compressor, where
Figure 9A:
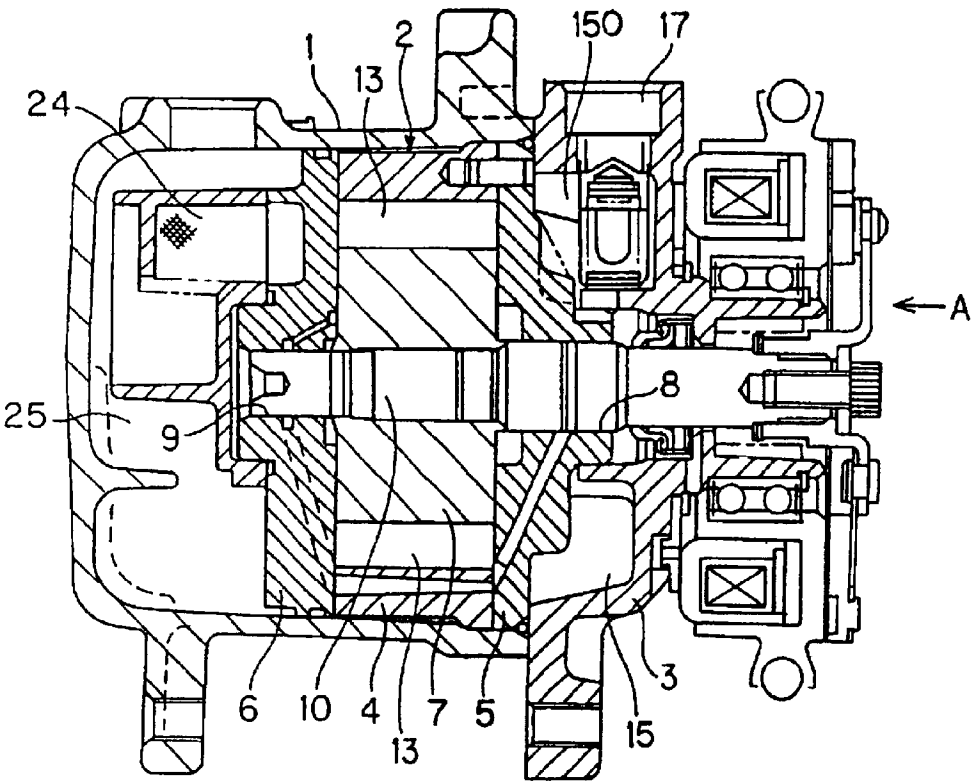
PRIOR ART FIG. 9A
Figure 10D:
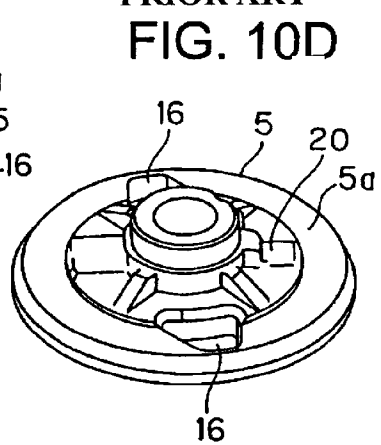
PRIOR ART FIG. 10D
FIGS. 10A to 10E are detailed explanatory views of the front head and the side block of the conventional gas compressor shown in FIGS. 9A and 9B, where
Figure 10C:
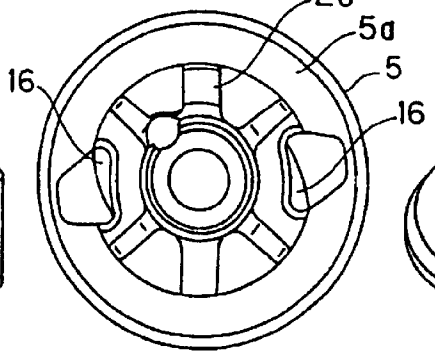
PRIOR ART FIG. 10C
Figure 10B:
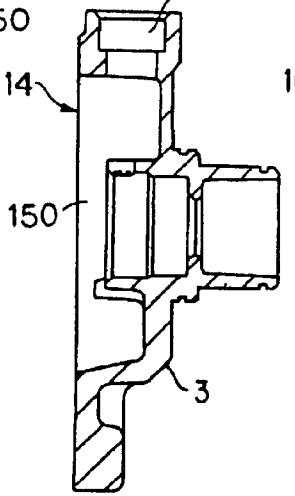
PRIOR ART FIG. 10B
Figure 10A:
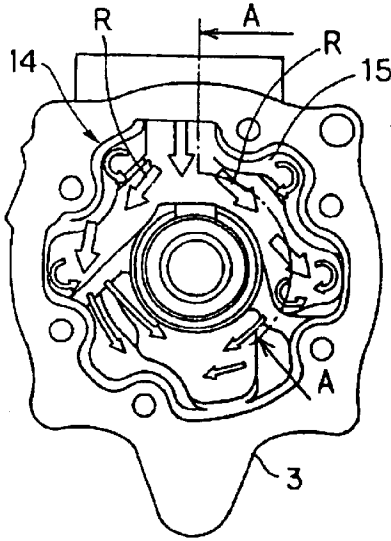
PRIOR ART FIG. 10A
Figure 10E:
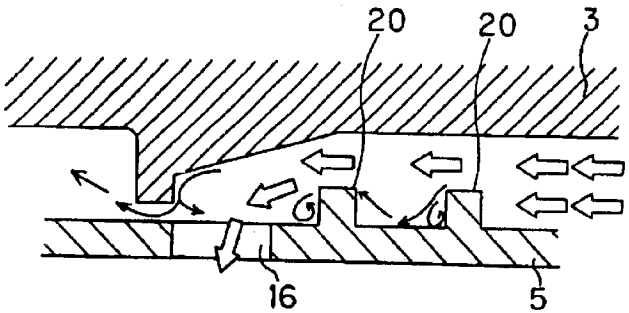
PRIOR ART FIG. 10E

That is, in the conventional gas compressor shown in FIGS. 9A and 9B, a plurality of reinforcing ribs 20 (See FIGS. 10A to 10E) protrude from the outer surface 5*a* of the side block 5, so that the suction chamber 150 has protrusions and recesses due to these reinforcing ribs 20. In contrast, the gas compressor of this embodiment adopts a construction in which the gaps between the reinforcing ribs 20 are filled by padding, whereby the outer surface 5*a* of the side block 5 is formed as a flat surface S.

Thus, in the gas compressor of this embodiment, no protrusions or recesses due to the reinforcing ribs 20 are generated in the suction passages 15. The reason for adopting this construction is also to make the flow of the refrigerant gas smooth and to reduce the pressure loss of the refrigerant gas as much as possible, thereby achieving an improvement in terms of cooling capacity.

Next, the operation of the gas compressor constructed as described above will be illustrated with reference to FIGS. 1A, 1B through FIGS. 3A to 3E.

In the case of the gas compressor shown in FIGS. 1A and 1B, when its operation is started and the rotor 7 is rotated together with the rotor shaft 10, the refrigerant gas is compressed in the compression chambers 13 (See FIG. 2). The compressed gas at high pressure is conveyed through cylinder discharge holes 21 open in the vicinity of the short-diameter portions of the cylinder 4 and discharge valves 22 provided at these cylinder discharge holes to flow into first discharge chambers 23 in the outer periphery of the cylinder 4. After flowing into the first discharge chambers 23, a high-pressure refrigerant gas further passes through a through-hole (not shown) formed in the rear side block and an oil separator 24 before it is discharged into a second discharge chamber 25.

Incidentally, the refrigerant gas compressed in the compression chambers 13 in the cylinder 4 as stated above is conveyed through the refrigerant guide passage shown in FIGS. 3A to 3E, that is, by way of the suction port 17 of the front head 3, the suction passages 15, and the side block suction holes 16, before it is sucked into the cylinder 4.

In this process, in the hollow portion 14 in the inner surface of the front head 3 forming the suction passages 15, the refrigerant gas flows smoothly along the flat wall surface 18-1 of the main flow passage R. Thus, the frictional resistance of the refrigerant gas in the refrigerant guide passage is low, and the pressure loss of the refrigerant gas is also reduced. Further, the density of the refrigerant -gas sucked into the cylinder 4 is enhanced, and the amount of the refrigerant gas sucked in increases, thereby achieving an improvement in cooling capacity.

Further, in the case of the gas compressor shown in FIGS. 1A and 1B, the hollow portion 14 in the inner surface of the front head 3 is entirely closed except for the main flow passage R. Thus, the residence time and the residence amount of the refrigerant gas deviated from the main flow passage R and residing in the hollow portion 14 in the inner surface of the front head are substantially reduced. The increase in the temperature of the refrigerant gas due to the residence and the resultant reduction in the density of the refrigerant gas also help to maintain the density of the refrigerant gas introduced into the cylinder 4 at a high level, and it is possible to suppress a reduction in the amount of the refrigerant gas introduced, which leads to an improvement in cooling capacity.

Further, the gas compressor shown in FIGS. 1A and 1B adopts a construction in which: (1) the bent portion R-1 in the main flow passage R for the refrigerant gas is formed in a curved configuration with a large radius of curvature; (2) the main flow passage R as a whole is formed as a continuous surface; and (3) the outer surface 5*a* of the side block 5 opposed to the hollow portion 14 in the inner surface of the front head 3 is also formed as a flat surface S free from protrusions or recesses. Thus, it is possible to prevent still more effectively a pressure loss and residence of the refrigerant gas in the refrigerant guide passage and the resultant problem, that is, a deterioration in cooling capacity.

FIG. 4 is a diagram showing experiment data obtained through comparison of the gas compressor of FIGS. 1A and 1B according to an embodiment of the present invention (hereinafter referred to the "compressor of the present invention") with the conventional gas compressor of FIGS. 9A and 9B (hereinafter referred to as the "conventional compressor") in terms of volumetric efficiency. The term "volumetric efficiency" refers to a value indicating the ratio of the volume of the refrigerant gas actually sucked into and trapped in the cylinder 4 to the geometric volume of the refrigerant gas that can be sucked into and trapped in the cylinder 4 of the compressor main body. As is apparent from this comparative experiment data, the compressor of the present invention is improved over the conventional one in terms of volumetric efficiency, and, as can be seen, the amount of the refrigerant gas actually sucked into and trapped in the cylinder 4 has been increased.

Figure 7:
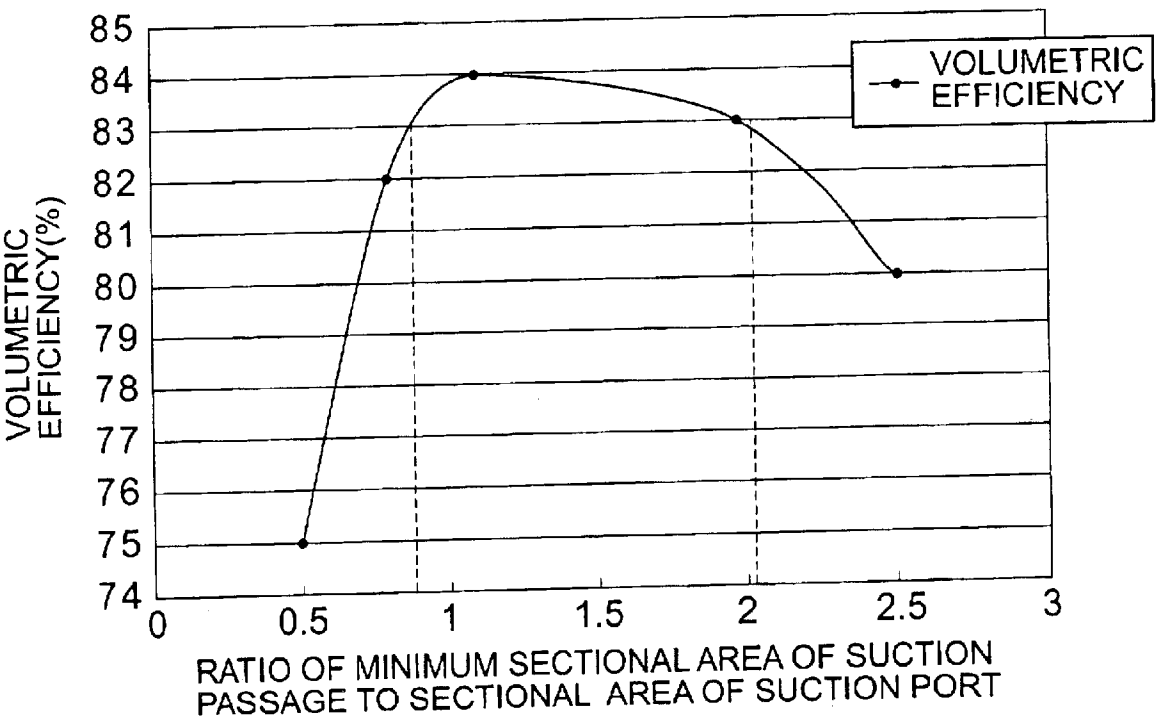
FIG. 7 is a graph showing data obtained through an experiment in order to examine the influence of the passage sectional area of the suction passage on volumetric efficiency in the compressor of the present invention.

FIG. 7 is a graph showing data obtained by an experiment conducted in order to examine the influence of the passage sectional area of the suction passages 15 on the volumetric efficiency in the compressor of the present invention. In this graph, the horizontal axis indicates the ratio of the minimum passage sectional area of the suction passages to the sectional area of the suction port ((minimum passage sectional area of suction passages)/(sectional area of suction port)), and the vertical axis indicates volumetric efficiency (%).

The expression: "the minimum passage sectional area of the suction passages" refers to the minimum passage sectional area of one of the two bifurcated suction passages 15. Further, the minimum passage sectional area of the suction passages is the sectional area of the section taken along the line D—D of FIG. 3A, and the sectional area of the suction port is the sectional area of the section taken along the line E—E of FIG. 3B.

As can be seen from this graph, the volumetric efficiency is optimum where the sectional area ratio slightly exceeds 1, that is, when the minimum passage sectional area of the suction passages is somewhat larger than the sectional area of the suction port.

A range of 1% from this optimum volumetric efficiency will be regarded as the permissible range of volumetric efficiency. For, at a level below this optimum value by 1%, the influence on the cooling capacity of the air conditioning system is so small as to be negligible.

Taking into account this permissible range of volumetric efficiency, it is desirable that the minimum passage sectional area of each suction passage be 0.9 to 2 times as large as the sectional area of the suction port. When the minimum passage sectional area of the suction passages 15 is set within this range; the volumetric efficiency, if rather poor, is within that permissible range, making it possible to obtain a superior cooling capacity.

As can be seen from the graph of the same drawing, when the sectional area ratio is reduced from the level around 1, the volumetric efficiency is abruptly deteriorated. It is to be assumed that this is due to the fact that when the minimum sectional area of the suction passages increases, a throttling effect around the minimum section becomes conspicuous to increase the suction resistance of the refrigerant gas, with the result that the amount of the refrigerant gas sucked into the cylinder per unit time is reduced.

On the other hand, when the sectional area ratio increases beyond the level around 1, the volumetric efficiency is deteriorated gently. It is to be assumed that this is due to the fact that as the minimum sectional area of the suction passages 15 increases, the effect of the "passage" configuration is lost gradually while the effect of the "chamber" configuration becomes conspicuous.

That is, as the minimum passage sectional area of the suction passages 15 increases, the configuration of the suction passages 15 becomes more analogous to that of a "chamber", so that the refrigerant gas becomes more likely to reside in the suction passages 15. During the residence, the refrigerant gas takes heat from the components of the side block 5, etc., resulting in an increase in the temperature of the refrigerant gas and, consequently, a reduction in the density of the refrigerant gas. Thus, the amount of the refrigerant gas sucked into the cylinder 4 per unit time decreases, so that it is to be assumed that the volumetric efficiency deteriorates gently.

Figure 8:
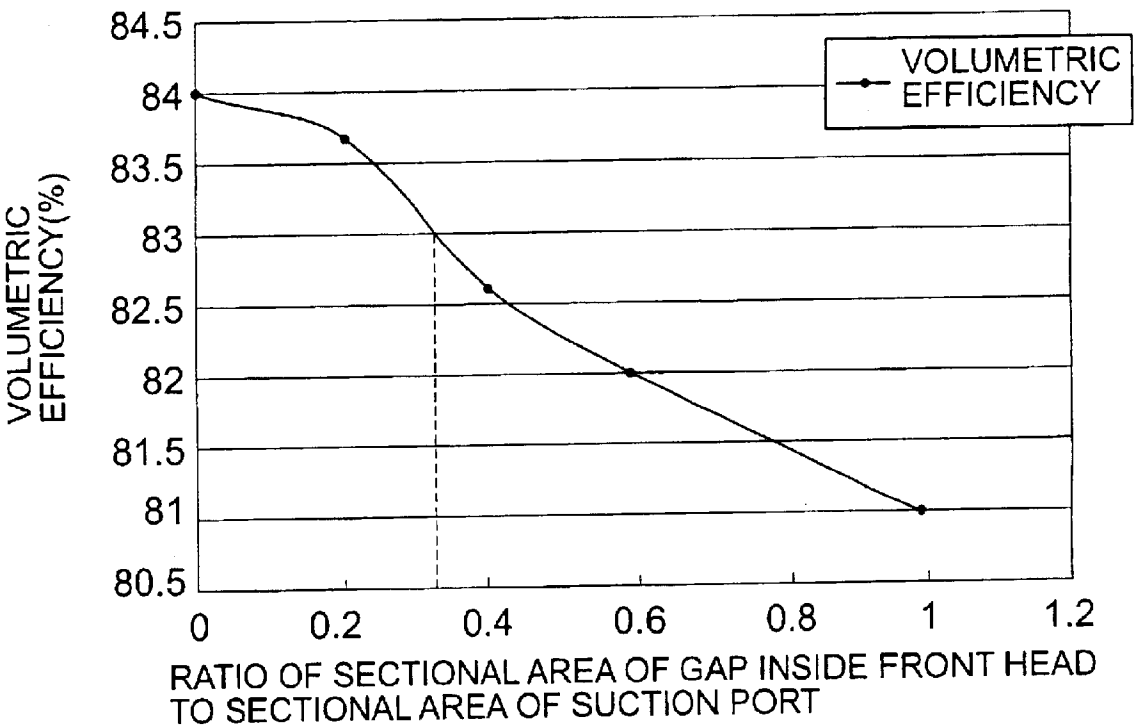
FIG. 8 is a graph showing data obtained through an experiment in order to examine the influence of the closing portion on volumetric efficiency in the compressor of the present invention.

FIG. 8 is a graph showing data obtained through an experiment conducted in order to examine the influence of the closing portion 19 on volumetric efficiency in the compressor of the present invention.

In the graph shown by FIG. 8, the horizontal axis indicates the ratio of the sectional area of the minute gap G. (hereinafter referred to as the "front head interior gap"; See FIG. 3E) between the closing portion 19 and the outer surface 5*a* of the side block opposed thereto to the sectional area of the suction port ((minimum passage sectional area of suction passages)/(sectional area of suction port)), and the vertical axis indicates volumetric efficiency (%).

Figures 3A, 3B, 3C, 3D, 3E:
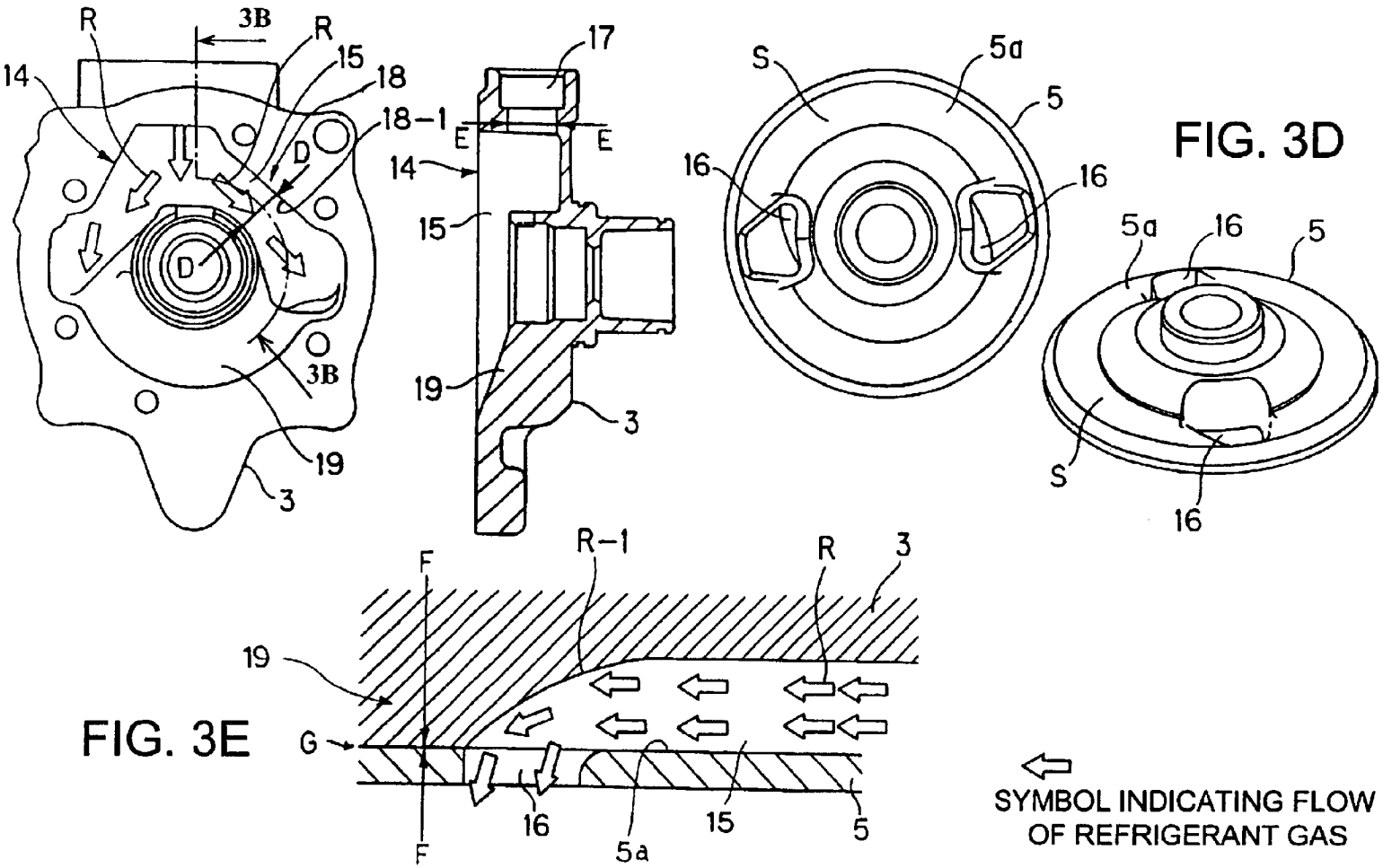
FIGS. 3A to 3E are a detailed explanatory views of the front head and the side block of the gas compressor shown in FIGS. 1A and 1B, where
Figures 5A, 5B, 5C, 5D, 5E:
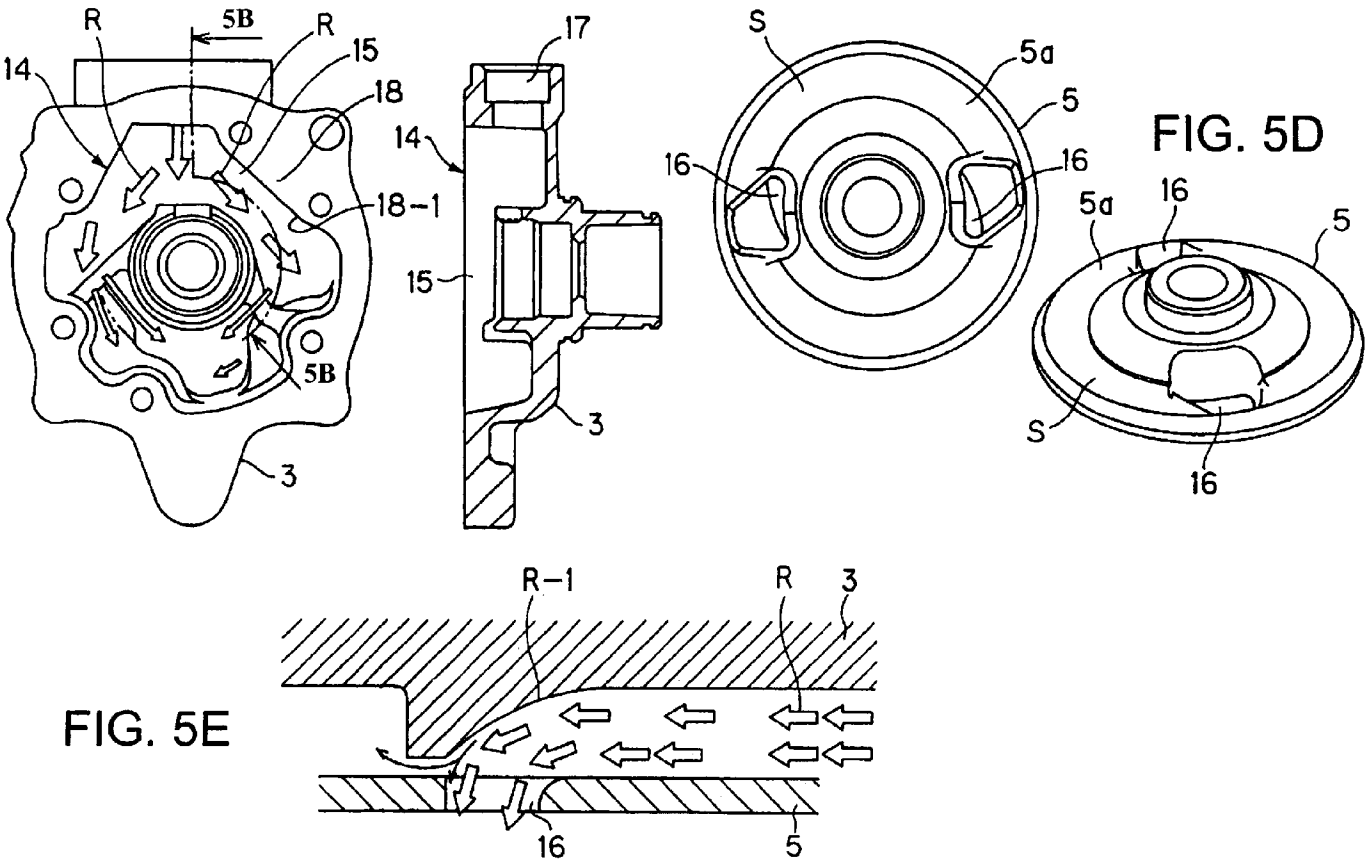
FIGS. 5A to 5E are explanatory views of another embodiment of the main portion of the present invention, where
Figures 6A, 6B, 6C, 6D, 6E:
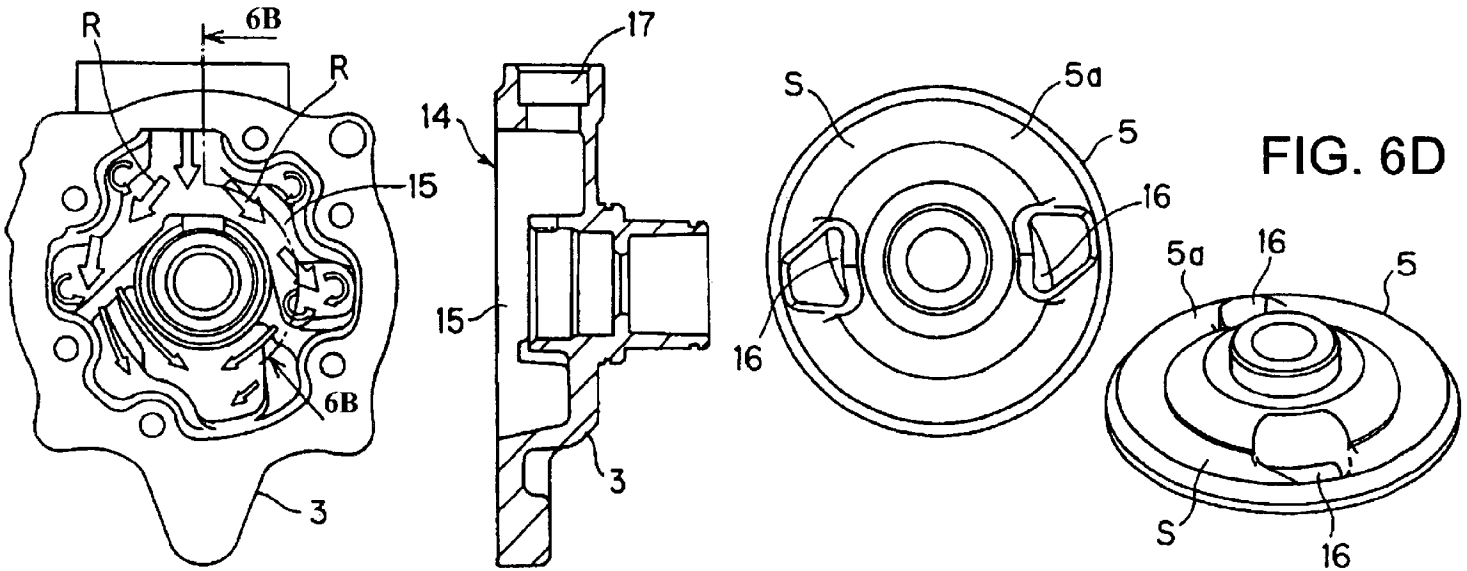
FIGS. 6A to 6E are explanatory views of another embodiment of the main portion of the present invention, where

Note that the sectional area of the front head interior gap G is the sectional area of the section taken along the line F—F of FIG. 3E. The minimum passage sectional area of the suction passages is as described above.

As can be seen from the graph, when the machining precision of the closing portion 19 and the side block outer surface 5*a* is so high as to enable the closing portion 19 and the side block outer surface 5*a* to be kept perfectly close contact with each other, and the front head interior gap G therebetween is 0, the sectional area ratio is 0, and the volumetric efficiency is maximum. When the ratio exceeds 0, the volumetric-efficiency deteriorates gradually as the size of the front head interior gap G increases. The sectional area ratio exceeds 0 when, for example, the requirement regarding the machining precision for the closing portion 19 and the side block outer surface 5*a* is relatively lenient as in the case of a mass-produced gas compressor, and the front head interior gap G is large.

In this case also, for the same reason as stated above, the range from the maximum volumetric efficiency to a level below that by 1% will be regarded as the permissible range for volumetric efficiency.

Taking into consideration this permissible range for volumetric efficiency, it is desirable that the sectional area of the gap G be 0 to 0.2 times as large as the sectional area of the suction port. When the front head interior gap G is set to be in this range, the volumetric efficiency, if rather poor, is within the permissible range, so that it is possible to obtain a superior cooling capacity.

As can be seen from the same graph, when the sectional area ratio exceeds the level around 0.2, the volumetric efficient is deteriorated markedly. It is to be assumed that this is attributable to the fact that the influence of the residence of the refrigerant gas becomes conspicuous in the portion corresponding to the front head interior gap G, and that an increase in the temperature of the refrigerant gas due to the residence and a reduction in the density of the refrigerant gas attributable there to occur, resulting in a reduction in the amount of the refrigerant gas sucked into the cylinder 4 per unit time.

The compressor of the present invention shown in FIGS. 7 and 8 exhibits a maximum volumetric efficiency of 84%, whereas the compressor of the present invention shown in FIG. 4 exhibits a volumetric efficiency of 85.7%, which means the two compressors according to the present invention differ in volumetric efficiency by 1.7%. However, this difference is attributable to the influence of the size, for example, of the minute rotor side gap between the cylinder 4 and the side block 5 closely related to the inner leakage of the refrigerant gas. Even with the compressor of the present invention exhibiting a volumetric efficiency of 84%, it is possible to increase the volumetric efficiency up to 85.7% by diminishing the rotor side gap, etc.

The above-described embodiment adopts all of the following constructions for achieving an improvement in cooling capacity: (1) the construction in which the hollow portion 14 in the inner surface of the front head is formed as a passage and, more specifically, in which the wall surface forming portion 18 and the closing portion 19 are provided on the inner surface side of the front head 3 (See FIG. 3A); (2) the construction in which, in the hollow portion 14 in the inner surface of the front head, the bent portion R-1 of the main flow passage R for the refrigerant gas is formed in a curved configuration with a large radius of curvature, and the main flow passage R as a whole is formed as a continuous surface (See FIG. 3E); and (3) the construction in which the outer surface 5*a* of the side block 5 opposed to the hollow portion 14 of the front head is formed as a flat surface (See FIGS. 3C and 3E). However, it is also possible to adopt only a part of these constructions (1) through (3) for achieving an improvement in cooling capacity. For example, it is possible, as shown in FIGS. 5A to 5E, to adopt the above constructions (2) and (3) and the wall surface forming portion 18 of the construction (1), omitting the closing portion 19 of the construction (1). Alternatively, it is also possible to adopt only the construction (3), as shown in FIGS. 6A to 6E.

In the present invention, there is provided in the inner surface of the front head a passage-like hollow portion branching off from the suction port and extending toward the side block suction holes, and a suction passage is formed for each side block hole by the passage-like hollow portion in the inner surface of the front head and the outer surface of the side block, whereby the following effects are provided:

(1) Since the refrigerant gas suction route from the suction port to the side block suction holes is not in the form of a chamber but in the form of a passage constituting the suction passage, it is possible to reduce the pressure loss of the refrigerant gas in the suction process. Further, no portion is involved which-allows the residence of the refrigerant gas during the suction process, so that it is possible to prevent an increase in the temperature of the refrigerant gas due to residence and a reduction in the density of the refrigerant gas attributable thereto. As a result, the amount of refrigerant gas sucked into the cylinder from the suction port side per unit time increases, making it possible to provide a gas compressor of high volumetric efficiency capable of enhancing the cooling capacity of an air conditioning system.

(2) A suction passage is formed for each side block suction hole, which is convenient in making the distances from the suction port constituting the suction start point to the side block holes, equal and short. Thus, it is possible to prevent the problem involved when only one of the side block suction holes is arranged at a position extremely far from the suction port, that is, an increase in the temperature of the refrigerant gas and a reduction in gas density attributable thereto. From this viewpoint also, the present invention is suitable for providing a gas compressor of high volumetric efficiency.

(3) Since the suction passage is formed on the outer surface side of the side block, the sealing surface on the inner surface side of the side block, that is, the sealing surface for sealing the gap between the inner surface of the side block and the cylinder end surface opposed thereto, is not restricted in width by the suction passage. It is possible to form on the side block inner surface side a sealing surface capable of sufficiently sealing the gap therebetween. Thus, it is possible to effectively prevent what is called inner leakage, in which the high-pressure refrigerant gas is leaked to the low pressure side from the interior of the cylinder through the gap therebetween, making it also possible to provide a gas compressor of high volumetric efficiency involving little inner leakage.

(4) Further, since the suction passage is formed on the side block outer surface side, it is possible to enlarge the width of the suction passage to secure the requisite passage sectional area thereof without adversely affecting the sealing surface on the side block inner surface side. Thus, in securing the requisite passage sectional area of the suction passage, due to the relationship with the sealing surface, there is no need to radially expand the side block and the cylinder itself, thus making it-also possible to provide a small-sized gas compressor providing a superior cooling capacity.

What is claimed is:

1. A gas compressor comprising:

a cylinder in which a refrigerant gas is compressed;

a side block mounted to an end surface of the cylinder, the side block having a plurality of suction holes each having a first end opening to an outer surface of the side block and a second end opening into the cylinder; and a front head having a suction port, an inner surface, and a hollow portion disposed in the inner surface, the front head being disposed on an outer surface of the side block so that the hollow portion and the outer surface of the side block form a plurality of suction passages extending from the suction port to respective suction holes of the side block, each of the suction passages forming a main flow passage along which refrigerant gas flows from the suction port to a corresponding one of the suction holes of the side block, the hollow portion having a generally flat wall surface at a region corresponding to each of the main flow passages.

2. A gas compressor according to claim 1; wherein the hollow portion of the front head has a closed structure except at portions thereof corresponding to the main flow passages.

3. A gas compressor according to claim 2; wherein a minimum passage sectional, area of each of the suction passages is 0.9 to 2 times as large as a sectional area of the suction port.

4. A gas compressor according to claim 2; wherein the closed structure of the hollow portion has a closed portion disposed opposite to and spaced-apart from the outer surface of the side block to define a space therebetween, a sectional area of the space being 0 to 0.2 times as large as a sectional area of the suction port.

5. A gas compressor according to claim 1; wherein a minimum passage sectional area of each of the suction passages is 0.9 to 2 times as large as a sectional area of the suction port.

6. A gas compressor according to claim 1; wherein the outer surface of the side block has a generally flat surface portion disposed opposite to and confronting the hollow portion of the front head.

7. A gas compressor comprising:

a cylinder in which a refrigerant gas is compressed;

a side block mounted to an end surface of the cylinder, the side block having a plurality of suction holes each having a first end opening to an outer surface of the side block and a second end opening into the cylinder; and a front head having a suction port, an inner surface, and a hollow portion disposed in the inner surface, the front head being disposed on an outer surface of the side block so that the hollow portion and the outer surface of the side block form a plurality of suction passages in which refrigerant gas flows and which extend from the suction port to respective suction holes of the side block, the hollow portion having a closing portion and a wall surface forming portion, the closing portion being formed so as to close the entire hollow portion in the inner surface of the front head except for the suction passages, and surfaces of the hollow portion corresponding to the suction passages being generally smooth and continuous without any interruptions to refrigerant gas flow for reducing a frictional resistance and pressure less of refrigerant gas flowing in the suction passages.

8. A gas compressor according to claim 7; wherein a minimum passage sectional area of each of the suction passages is 0.9 to 2 times as large as a sectional area of the suction port.

9. A gas compressor according to claim 7; wherein the closed structure of the hollow portion has a closed portion disposed opposite to and spaced-apart from the outer surface of the side block to define a space therebetween, a sectional area of the space being 0 to 0.2 times as large as a sectional area of the suction port.

10. A gas compressor comprising:

a cylinder in which a refrigerant gas is compressed;

a side block mounted to an end surface of the cylinder, the side block having a plurality of suction holes each having a first end opening to an outer surface of the side block and a second end opening into the cylinder; and a front head having a suction port and a hollow portion extending from the suction port and confronting an outer surface of the side block in spaced-apart relation thereto to form therebetween a plurality of suction passages in which refrigerant gas flows and which extend from the suction port to respective suction holes of the side block, the hollow portion having a closing portion and a wall surface forming portion, the closing portion being formed so as to close the entire hollow portion in the surface of the front head except for the suction passages, and the outer surface of the side block corresponding to the suction passages being generally smooth and continuous without any interruptions to refrigerant gas flow for reducing a frictional resistance and pressure loss of refrigerant gas flowing in the suction passages.

11. A gas compressor according to claim 10; wherein a minimum passage sectional area of each of the suction passages is 0.9 to 2 times as large as a sectional area of the suction port.

12. A gas compressor according to claim 10; wherein the closed structure of the hollow portion has a closed portion disposed opposite to and spaced-apart from the outer surface of the side block to define a space therebetween, a sectional area of the space being 0 to 0.2 times as large as a sectional area of the suction port.

* * * * *